United States Patent [19]

Denzinger et al.

[11] Patent Number: 4,698,174

[45] Date of Patent: Oct. 6, 1987

[54] ADDITIVES FOR DETERGENTS AND CLEANING AGENTS

[75] Inventors: Walter Denzinger, Speyer; Heinrich Hartmann, Limburgerhof; Wolfgang Trieselt, Ludwigshafen; Albert Hettche, Hessheim; Rolf Schneider, Mannheim; Hans-Juergen Raubenheimer, Ketsch, all of Fed. Rep. of Germany

[73] Assignee: BASF Aktiengesellschaft, Ludwigshafen, Fed. Rep. of Germany

[21] Appl. No.: 822,610

[22] Filed: Jan. 27, 1986

[30] Foreign Application Priority Data

Feb. 13, 1985 [DE] Fed Rep. of Germany .... 35-04896

[51] Int. Cl.[4] ..... C11D 0/6

[52] U.S. Cl. ..... 252/174.24; 252/527; 252/546

[58] Field of Search ..... 252/174.24, 527, 546

[56] References Cited

U.S. PATENT DOCUMENTS

| | | | |
|---|---|---|---|
| 3,463,734 | 8/1969 | Carter et al. | 252/99 |
| 3,684,779 | 8/1972 | Rapko | 252/174.24 |
| 3,708,436 | 1/1973 | Thompson et al. | 252/527 |
| 4,517,023 | 5/1985 | Barabas | 252/174.24 |
| 4,559,159 | 12/1985 | Denzinger et al. | 252/174.24 |

*Primary Examiner*—Paul Lieberman
*Assistant Examiner*—Willie J. Thompson
*Attorney, Agent, or Firm*—Oblon, Fisher, Spivak, McClelland & Maier

[57] ABSTRACT

Pulverulent and/or granular additives for pulverulent detergents and cleaning agents, consisting of (a) from 80 to 20% by weight of one or more copolymers comprising from 40 to 90% by weight of (meth-)acrylic acid and from 60 to 10% by weight of maleic acid and/or one or more copolymers comprising from 10 to 45% by weight of (meth)acrylic acid, from 10 to 45% by weight of maleic acid and from 10 to 60% by weight of one or more hydroxyalkyl (meth)acrylates where hydroxyalkyl is of 2 to 6 carbon atoms, if appropriate in the form of a partially or completely neutralized water-soluble salt, (b) from 20 to 80% by weight of nitrilotriacetic acid or its mono-, di- or trisodium or mono-, di- or tripotassium salt and (c) from 0 to 20% by weight of one or more additives conventionally used for detergent and cleaning agent formulations, the use of these pulverulent and/or granular mixtures as additives for pulverulent and/or granular detergents and cleaning agents, and processes for the preparation of the said additives.

10 Claims, No Drawings

ADDITIVES FOR DETERGENTS AND CLEANING AGENTS

The present invention relates to pulverulent and or granular additives for pulverulent detergent and cleaning agent formulations.

Polymeric polycarboxylic acids and their salts are conventional additives for detergent and cleaning agent formulations and improve the primary washing action and the incrustation-inhibiting and antiredeposition actions in an outstanding manner. In the preparation of detergent formulations for use, the polymeric carboxylic acids or their salts are added to the detergent slurries as a rule in the form of aqueous solutions, after which drying is carried out. The disadvantage of this procedure is that this addition increases the viscosity of the slurries, and precipitates may separate out in unfavorable cases.

It is therefore advantageous to prepare the polymeric carboxylic acids or their salts in solid form and subsequently to mix the resulting solid product, in the form of a powder or granules, with the pulverulent or granular detergents. However, the disadvantage of the solid polymeric carboxylic acids, and particularly their salts, is that they are very hygroscopic and have a low bulk density.

It is an object of the present invention to reduce these disadvantages substantially in order to permit better industrial processing of polymeric carboxylic acids and their salts in powder form, ie. to reduce the hygroscopicity and increase the bulk density.

We have found that this object is achieved and that, surprisingly, the disadvantages described can be overcome using a mixture with nitrilotriacetic acid or its sodium salts.

The present invention relates to a homogeneous mixture in the form of a powder or granules, as an additive for pulverulent and/or granular detergents and cleaning agents, which consists of (a) from 80 to 20% by weight of one or more copolymers comprising from 40 to 90% by weight of (meth)acrylic acid and from 60 to 10% by weight of maleic acid and/or one or more copolymers comprising from 10 to 45% by weight of (meth)acrylic acid, from 10 to 45% by weight of maleic acid and from 10 to 60% by weight of one or more hydroxyalkyl (meth)acrylates where hydroxyalkyl is of 2 to 6 carbon atoms, if appropriate in the form of a water-soluble salt, (b) from 20 to 80% by weight of nitrilotriacetic acid or its mono-, di- or trisodium or mono-, di- or tripotassium salt, and (c) from 0 to 20% by weight of one or more additives conventionally used for detergent and cleaning agent formulations, and the use of this pulverulent or granular mixture as an additive for pulverulent or granular detergent and cleaning agent formulations.

Pulverulent is intended to mean a finely divided powder ranging to a material in the form of particles or granules, this definition applying both to the novel additive and to the detergents and cleaning agents.

The novel pulverulent additives can be characterized by mean particle diameters of from 10 to 500 μm, preferably from 50 to 300 μm, with a large proportion in the range from 100 to 300 μm, in the size distribution. As a rule, the granules have a mean particle size of from 0.2 to 10 mm, preferably from 0.3 to 5 mm, particularly preferably from 0.5 to 2 mm. The particle sizes depend in particular on the drying method, spray drying and drying in a fluidized bed, in particular in the form of spray granulation, being preferred.

In the preferred embodiment, the stated (meth)acrylic acid/maleic acid copolymers contain, as monomer units, from 45 to 85% of (meth)acrylic acid and from 55 to 15% of maleic acid, the percentages being based on the total weight of the copolymer. (Meth)acrylic acid is acrylic acid or methacrylic acid or a mixture of the two acids.

The preferred copolymers with hydroxyalkyl (meth)acrylates contain from 10 to 40% by weight of (meth)acrylic acid, from 10 to 40% by weight of maleic acid and from 20 to 50% by weight of one or more hydroxyalkyl (meth)acrylates where hydroxyalkyl is of 2 to 6 carbon atoms, the percentages being based on the total weight of the copolymer. The hydroxyalkyl ester groups of the hydroxyalkyl (meth)acrylates are derived from, for example, alkanediols, such as ethane-1,2-diol, propane-1,3-diol or propane-1,2-diol, or industrial mixtures of these, neopentylglycol, pentane-1,5-diol or hexane-1,6-diol. Specific examples are hydroxethyl methacrylate, hydroxypropyl methacrylates, butanediol monomethacrylate, neopentylglycol monoacrylate, pentane-1,5-diol monoacrylate and hexane-1,6-diol monoacrylate. The preferred hydroxyalkyl esters are hydroxyethyl acrylate, butane-1,4-diol monoacrylate and the hydroxypropyl acrylates. The particularly preferred hydroxyalkyl esters are the hydroxypropyl acrylates, and the isomer mixtures consisting of 2-hydroxyprop-1-yl acrylate and 1-hydroxyprop-2-yl acrylate are of particular industrial importance, these isomer mixtures being prepared by reacting acrylic acid with propylene oxide.

Mixtures of the stated (meth)acrylic acid/maleic acid copolymers and copolymers of (meth)acrylic acid, maleic acid and hydroxyalkyl (meth)acrylates can advantageously be used.

The copolymers are preferably used in the form of the water-soluble alkali metal salts, such as the sodium salts or potassium salts, in particular the sodium salts. However, they can also be employed in the form of water-soluble ammonium salts or organic amine salts, in particular the salts of trialkylamines, where alkyl is of 1 to 4 carbon atoms, or the salts of mono-, di- or trialkanolamines, where the alkanol radical is of 1 to 4 carbon atoms. If required, mixtures of the stated amine salts may also be used. Specific examples are mono-, di- and trihydroxyethylamine. It may be advantageous to use different salts together, such as sodium salts and potassium salts, or sodium salts and alkanolamine salts.

The water-soluble salts are advantageously partially or completely neutralized salts. For practical use, as a rule from 50 to 100% of the carboxyl groups are neutralized.

The (meth)acrylic acid/maleic acid copolymers are known, and are obtainable by conventional methods of preparation, for example as described in EP-A-75 820 or DE-A 3 233 777, 3 233 778, 3 233 775 and 3 233 776. The copolymers with hydroxyalkyl (meth)acrylates can be obtained, for example, as described in German Patent Application P 34 26 368.

The copolymers used according to the invention have K values of from 8 to 150, preferably from 10 to 100, measured at 25° C. in a 1% strength by weight aqueous solution brought to pH 7 with sodium hydroxide solution, using a method due to Fikentscher, Cellulosechemie 13 (1932), 58 et seq. For these polymeric polycarboxylic acids, the K value is an advantageous characteristic.

The preferred ratios of the components in the mixtures for the novel additives are from 30 to 70, very particularly preferably from 60 to 40, % by weight of (a) and from 70 to 30, very particularly preferably from 40 to 60, % by weight of (b), a ratio of about 1:1 having proven particularly useful in industry.

The substances (c), which are usually non-surfactant additives for detergents and cleaning agents and need not necessarily be present in the novel mixture, are in general detergent and cleaning agent additives, eg. sodium sulfate, sodium tripolyphosphate, soluble and insoluble sodium silicates, magnesium sulfate, sodium carbonate, organic phosphonates, sodium aluminum silicates of the zeolite A type and mixture of the stated substances.

The additive according to the invention is advantageously prepared by mixing an aqueous solution of the polymeric carboxylic acid or a water-soluble salt with an aqueous solution of nitrilotriacetic acid or one of its sodium salts and, if required, an aqueous solution or suspension of one or more substances (c), and then drying the mixture. Of course, the individual substances may also be added separately to the aqueous solution, in solid form. Preferably, these solutions have a pH of from 5 to 10, preferably from 7 to 9, and a solids content of from 20 to 70%.

Drying is carried out by a conventional method in a known drying apparatus at from 70° to 200° C., preferably from 80° to 180° C. Examples of suitable drying processes are belt drying, drum drying, freeze drying, spray drying or drying in a fluidized bed. Spray drying is particularly useful for producing a fine powder, while drying in a fluidized bed is particularly suitable for producing granules, spray granulation being particularly useful for this purpose in a particular embodiment.

The particle sizes can be varied within a range appropriate for the drying processes used, since the resulting particle sizes depend to a smaller extent on the composition of the particles than on the method of drying. In spray granulation, it is advantageous initially to take a novel spray-dried powder having mean particle sizes of from 50 to 500 μm and then to enlarge the particles in a fluidized bed by spraying on further solution.

The novel additives or mixtures for detergents and cleaning agents have the advantage that they are extremely easy to handle, are powders or granules possessing little hygroscopicity and a high bulk density, and can be added directly to the detergent powders.

The nitrilotriacetic acid and its sodium salts, which are employed for reducing the hygroscopicity and increasing the bulk density, are sequestering agents which are conventionally used for detergents and which have been introduced into a large number of detergents and cleaning agents and are therefore not extenders which cause unnecessary pollution.

The examples which follow illustrate the invention. Parts are by weight. As stated above, the K values are determined according to H. Fikentscher. In the case of the hygroscopicity, a sample of about 2 g is introduced into a weighing glass of about 5 mm diameter and the water absorption of the predried powder after storage for 24 hours at 68% relative humidity and 20° C. is determined. The particle sizes are determined by dry screening the particular powder using an electromagnetic screening machine (Analysette 3 from Fritsch).

EXAMPLE 1

A 45% strength solution of a cOpolymer of 70% by weight of acrylic acid and 30% by weight of maleic acid, which had a K value of 50 and in which 50% of the carboxyl groups had been neutralized with sodium hydroxide, was mixed with a 38% strength solution of trisodium nitrilotriacetate (NTA), and the mixture was dried in a spray drier having a two-material nozzle, the temperature of the inlet air being 150° C. and that of the exit air being 90° C. The amounts, the bulk density and the water absorption are shown in the Table below.

| Copolymer solution [parts] | NTA solution [parts] | pH of the mixture | Bulk density [gml] | $H_2O$ absorption [%] |
|---|---|---|---|---|
| 167 | 66 | 7.2 | 0.375 | 8.7 |
| 100 | 59 | 7.5 | 0.400 | 7.9 |
| 100 | 112 | 7.9 | 0.596 | 5.6 |
| 100 | 355 | 9.0 | 0.612 | 7.8 |
| Comparison | | | | |
| 100 | — | 6.0 | 0.260 | 14.8 |
| | 100 | 11.4 | 0.480 | 6.9 |

The particle sizes of the powders are from 50 to 500 μm, 70% of the particles being in the range from 100 to 200 μm.

EXAMPLE 2

A 50% strength solution of a copolymer of 65% by weight of acrylic acid and 35% by weight of maleic acid, which had a K value of 24 and in which 50% of the carboxyl groups had been neutralized with sodium hydroxide, was mixed with 38% strength NTA solution, and the mixture was dried and then tested, as described in Example 1.

| Copolymer solution [parts] | NTA solution [parts] | pH of the mixture | Bulk density [g/ml] | $H_2O$ absorption [%] |
|---|---|---|---|---|
| 100 | 132 | 7.5 | 0.550 | 7.0 |
| Comparison | | | | |
| 100 | — | 5.9 | 0.437 | 10.5 |

The particle sizes of the powder are similar to Example 1.

EXAMPLE 3

A 38% strength solution of a copolymer of 50% by weight of acrylic acid and 50% by weight of maleic acid, which had a K value of 42 and in which 65% of the carboxyl groups had been neutralized with sodium hydroxide, was mixed with 38% strength NTA Solution, and the mixture was dried and tested, as described in Example 1.

| Copolymer solution [parts] | NTA solution [parts] | pH of the mixture | Bulk density [g/ml] | $H_2O$ absorption [%] |
|---|---|---|---|---|
| 100 | 100 | 7.5 | 0.550 | 6.1 |
| Comparison | | | | |
| 100 | — | 6.7 | 0.339 | 9.9 |

The particle sizes of the powder are similar to Example 1.

EXAMPLE 4

100 parts of a 40% strength solution of a copolymer of 70% by weight of acrylic acid and 30% by weight of maleic acid, which had a K value of 60 and in which 60% of the carboxyl groups had been neutralized with sodium hydroxide, 132 parts of a 38% strength NTA solution and 20 parts of a 50% strength sodium sulfate solution were mixed, and the mixture was dried by atomizing it in a spray tower with a centrifugal disk atomizer at 12,000 rpm, the temperature of the inlet air being 150° C. and that of the exit air being 90° C. The product was then tested.

Bulk density: 0.690 [g/ml].

$H_2O$ absorption: 7.4%.

The particle sizes of the powder were from 25 to 300 μm, the major part, ie. about 80%, being in the range from 70 to 110 μm.

EXAMPLE 5

A 40% strength solution of a copolymer of 30% by weight of methacrylic acid, 45% by weight of acrylic acid and 25% by weight of maleic acid, which had a K value of 98 and in which 90% of the carboxyl groups had been neutralized with sodium hydroxide, was mixed with a 40% strength solution of disodium nitrilotriacetate. Half the mixture was dried in a spray drier as described in Example 1 and introduced into a fluidized bed, and the remainder of the mixture was sprayed on at a gas temperature of about 140° C. This spray granulation procedure gives granules having a diameter of about 0.5–5 mm. The test results are shown in the Table below:

| Copolymer solution [parts] | Disodium nitrilotriacetate solution [parts] | pH of the mixture | Bulk density [g/ml] | $H_2O$ absorption [%] |
|---|---|---|---|---|
| 80 | 120 | 7.4 | 0.530 | 5.6 |
| 100 | 100 | 7.6 | 0.540 | 5.7 |
| 120 | 80 | 7.8 | 0.540 | 6.9 |
| Comparison | | | | |
| 100 | 0 | 8.0 | 0.435 | 12.7 |
| 0 | 100 | 7.0 | 0.450 | 7.1 |

EXAMPLE 6

A 38% strength solution of a copolymer of 40% by weight of acrylic acid, 40% by weight of maleic acid and 20% by weight of hydroxypropyl acrylate (industrial isomer mixture consisting of about 67% by weight of 2-hydroxyprop-1-yl acrylate and about 33% by weight of 1-hydroxyprop-2-yl acrylate), which had a K value of 42 and in which 70% of the carboxyl groups had been neutralized with sodium hydroxide, was mixed with a 38% strength NTA solution, and the mixture was dried as described in Example 1, but using a one-material nozzle, and the product was tested.

| Copolymer solution [parts] | NTA solution [parts] | pH of the mixture | Bulk density [g/ml] | $H_2O$ absorption [%] |
|---|---|---|---|---|
| 160 | 40 | 7.0 | 0.580 | 4.3 |
| 120 | 80 | 7.2 | 0.600 | 4.1 |
| 100 | 100 | 7.4 | 0.610 | 3.9 |
| 80 | 120 | 7.7 | 0.620 | 5.1 |
| 40 | 160 | 7.8 | 0.590 | 6.4 |
| Comparison | | | | |
| 100 | 0 | 6.8 | 0.390 | 11.0 |

The particle sizes of the powders are from 50 to 500 μm, about 70% of the particles being in the range from 200 to 350 μm.

EXAMPLE 7 TO 12

100 parts of a 38% strength solution of a copolymer shown in the Table below, in which 90% of the carboxyl groups had been neutralized with sodium hydroxide, were mixed with 100 parts of a 38% strength NTA solution, and the mixture was dried and then tested, as described in Example 1.

TABLE

| | EXAMPLES 7 TO 12 | | | | Comparison of the copolymer without NTA | |
|---|---|---|---|---|---|---|
| Example No. | Copolymer composition [% by weight] | K value | Bulk density [g/ml] | $H_2O$ absorption [%] | Bulk density [g/ml] | $H_2O$ absorption [%] |
| 7 | 30 AA/30 MA/40 HPA | 42 | 0.610 | 6.5 | 0.380 | 13.1 |
| 8 | 25 AA/25 MA/50 HPA | 21 | 0.630 | 4.6 | 0.410 | 11.9 |
| 9 | 30 AA/40 MA/30 HEA | 62 | 0.590 | 5.9 | 0.375 | 12.9 |
| 10 | 20 MAA/20 AA/40 MA/20 HEA | 56 | 0.470 | 4.7 | 0.290 | 10.8 |
| 11 | 25 MAA/25 MA/50 HPA | 76 | 0.610 | 4.9 | 0.400 | 11.2 |
| 12 | 40 AA/20 MAA/20 HPA/ 20 HEMA | 39 | 0.625 | 4.3 | 0.390 | 8.6 |

AA: Acrylic acid
MAA: Methacrylic acid
MA: Maleic acid
HPA: Hydroxypropyl acrylate (mixture of 67% of 2-hydroxyprop-1-yl acrylate and 33% of 1-hydroxyprop-2-yl acrylate)
HEA: Hydroxyethyl acrylate
HEMA: Hydroxyethyl methacrylate
The particle sizes of the powders were similar to Example 1

EXAMPLE 13

50 parts of a 38% strength aqueous solution of a copolymer of 40% by weight of acrylic acid, 40% by weight of maleic acid and 20% by weight of hydroxypropyl acrylate (industrial isomer mixture consisting of about 67% by weight of 2-hydroxyprop-1-yl acrylate and about 33% by weight of 1-hydroxyprop-2-yl acrylate), which had a K value of 42 and in which 70% of the carboxyl groups had been neutralized with sodium hydroxide, and 50 parts of a 38% strength aqueous solution of a copolymer of 50% by weight of acrylic acid and 50% by weight of maleic acid which had a K value of 42 and in which 65% of the carboxyl groups had been neutralized with sodium hydroxide, were mixed with 100 parts of a 38% strength solution of disodium nitrilotriacetate, the pH of the resulting solution being 7.4. This solution was dried and then tested, as described in Example 1.

Bulk density: 0.660 [g/ml].

$H_2O$ absorption: 5.1%.

Comparison: Dry product obtained from the two copolymer solutions in equal amounts.

Bulk density: 0.385 [g/ml].

$H_2O$ absorption: 9.9%.

The particle sizes of the powders were similar to Example 1.

We claim:

1. A pulverulent and/or granular additive for pulverulent detergents and cleaning agents, which consists of:

(A) from 80 to 20% by weight of (i) at least one copolymer consisting of from 40 to 90% by weight of (meth)acrylic acid and from 60 to 10% by weight of maleic acid, (ii) at least one copolymer consisting of from 10 to 45% by weight of (meth)acrylic acid, from 10 to 45% by weight of maleic acid and from 10 to 60% by weight of at least one hydroxy($C_{2-6}$)alkyl (meth)acrylate, or (iii) mixtures of copolymers (i) and (ii), said copolymers (i) and (ii) optionally being in the form of water-soluble salts;

(B) from 20 to 80% by weight of nitrilotriacetic acid or its mono-, di- or trisodium or mono-, di- or tripotassium salt; and (C) from 0 to 20% by weight of at least one additive conventionally used for detergent and cleaning agent formulations.

2. The additive of claim 1, wherein the mean particle diameter of said additive ranges from 10 to 500 μm.

3. The additive of claim 2, wherein the mean particle diameter of said additive ranges from 50 to 300 μm.

4. The additive of claim 1, wherein said copolymer (i) consists of from 45 to 85% (meth)acrylic acid and from 55 to 15% maleic acid.

5. The additive of claim 1, wherein said copolymer (ii) consists of from 10 to 40% by weight of (meth)acrylic acid, from 10 to 40% by weight maleic acid and from 20 to 50% by weight of at least one hydroxy($C_{2-6}$)alkyl (meth)acrylate.

6. The additive of claim 1, wherein said hydroxy($C_{2-6}$)alkyl (meth)acrylate is hydroxyethyl methacrylate, hydroxypropyl methacrylate, butanediol monomethacrylate, neopentylglycol methacrylate, pentane-1,5-diol monoacrylate or hexane-1,6-diol monoacrylate.

7. The additive of claim 1, wherein said copolymers (i) and (ii) have from 50 to 100% of the carboxyl groups therein neutralized.

8. The additive of claim 1, wherein said copolymers (i) and (ii) have K values ranging from 8 to 150 as measured at 25° C. in a 1% strength by weight aqueous solution at a pH of 7.

9. The additive of claim 8, wherein said K value ranges from 10 to 100.

10. A process for the preparation of a pulverulent and/or granular additive as claimed in claim 1 for pulverulent detergents and cleaning agents, which comprising:

preparing an aqueous solution or suspension containing from 20 to 70% by weight of the mixture claimed in claim 3; and drying said aqueous mixture at a temperature ranging from 70° to 200° C.

* * * * *